US007083323B2

(12) United States Patent
Zambaux

(10) Patent No.: US 7,083,323 B2
(45) Date of Patent: Aug. 1, 2006

(54) FLEXIBLE MIXING BAG FOR MIXING SOLIDS, LIQUIDS AND GASES

(75) Inventor: Jean-Pascal Zambaux, Riom (FR)

(73) Assignee: Advanced Technology Materials, Inc., Danbury, CT (US)

( * ) Notice: Subject to any disclaimer, the term of this patent is extended or adjusted under 35 U.S.C. 154(b) by 135 days.

(21) Appl. No.: 10/440,625

(22) Filed: May 19, 2003

(65) Prior Publication Data

US 2004/0233779 A1 Nov. 25, 2004

(51) Int. Cl.
*B01F 9/02* (2006.01)

(52) U.S. Cl. ..... 366/213; 366/220; 206/221

(58) Field of Classification Search ..... 206/219, 206/221, 222; 366/129, 130, 213, 214, 220, 366/235; 494/21
See application file for complete search history.

(56) References Cited

U.S. PATENT DOCUMENTS 2,663,298 A * 12/1953 Rose ..... 604/92
2,798,488 A * 7/1957 Hall ..... 604/82
3,110,308 A * 11/1963 Bellamy, Jr. ..... 604/410
3,190,619 A * 6/1965 Knittel et al. ..... 366/129
3,911,918 A * 10/1975 Turner ..... 604/410
3,999,742 A * 12/1976 Heyraud ..... 366/180.1
4,731,053 A * 3/1988 Hoffman ..... 604/89
4,952,068 A * 8/1990 Flint ..... 366/337
4,994,057 A * 2/1991 Carmen et al. ..... 604/416
6,612,769 B1 * 9/2003 Lee et al. ..... 401/183
6,773,389 B1 * 8/2004 Hlavinka et al. ..... 494/60
2002/0029985 A1 * 3/2002 Stunnell ..... 206/221

* cited by examiner

*Primary Examiner*—David Sorkin
(74) *Attorney, Agent, or Firm*—Kinney & Lange, P.A.

(57) ABSTRACT

In an embodiment, an apparatus includes a conduit. The apparatus also includes two or more flexible compartments. Each of the two or more flexible compartments has an interior wall defining a storage area configured to house a substance. Each of the two or more flexible compartments includes a distal end and a proximal end. The proximal ends of the two or more flexible compartments are coupled to the conduit such that the conduit defines a passageway between the two or more flexible compartments. A diameter of the storage area at the proximal end is less than a diameter of the storage area at the distal end.

20 Claims, 9 Drawing Sheets

FLEXIBLE MIXING BAG FOR MIXING SOLIDS, LIQUIDS AND GASES

TECHNICAL FIELD

This invention generally relates to mixing of substances and more particularly to a flexible mixing bag for mixing of solids, liquids, gases and combinations thereof.

BACKGROUND

The mixing of substances, such as different types of solids, liquids and/or gases has a number of applications in different industries. For example, in the pharmaceutical industry, different types of drugs are mixed together. In the medical field, body fluids (such as blood) and/or drugs are typical substances that are mixed. The agricultural industry also incorporates mixing operations into a number of applications. For example, water is mixed with dehydrated food for the rehydration of such food.

However, in these and other industries, the substances that are mixed may be hazardous, dangerous and/or infectious. For example, in the pharmaceutical and/or medical industries, the substances that are to be mixed may be toxic. Additionally, in a number of situations, the handling of powders may be dangerous because of the possibilities of inhalation of such powders. Furthermore, in the medical field, individuals that handle body fluids, such as fluids that are HIV-infected, do so without attempting direct contact of these fluids.

Conventional mixing devices generally involve a glass tank for substances that are of small volumes and a stainless steel tank for substances of larger volumes. These tanks often include a screw to agitate and maintain powders within suspension. Such screws are also used to homogenize multiphase solutions. Prior to use, these mixing tanks must be washed and sterilized. Typically, an autoclave is used for washing and sterilizing small volume tanks, while a water steam-based operation is employed for washing and sterilizing larger volume tanks. These wash and sterilize operations, which are essential to mixing when using such devices, are typically time consuming, expensive and require highly qualified individuals. Further, periodic maintenance of these mixing devices must be performed to ensure proper operation. In certain cases, such washing/sterilizing operations as well as the maintenance of these mixing devices may represent more than a third of the total cost of the mixing devices and maintaining thereof, which may be prohibitive for given applications. Additionally, mixing of substances may cause the pressure to increase within these conventional mixing devices. If this increased pressure is not accounted for, the mixing of such substances may become dangerous, wherein the tanks could break apart/explode due to this internal pressure. Moreover, with the use of many mixing devices currently employed to mix pharmaceuticals, one cannot be certain whether any such pharmaceutical has been displaced outside the mixing device and therefore the amount of pharmaceutical remaining inside the mixing device, after mixing, may not be sufficiently accurate or precise. This is problematic when the FDA requires the administration of such a pharmaceutical in precise, accurate and known quantities.

BRIEF DESCRIPTION OF THE DRAWINGS

Embodiments of the invention may be best understood by referring to the following description and accompanying drawings which illustrate such embodiments. The numbering scheme for the Figures included herein are such that the leading number for a given reference number in a Figure is associated with the number of the Figure. For example, a flexible mixing tank 100 can be located in FIG. 1. However, reference numbers are the same for those elements that are the same across different Figures. In the drawings.

SUMMARY

Figure 1:
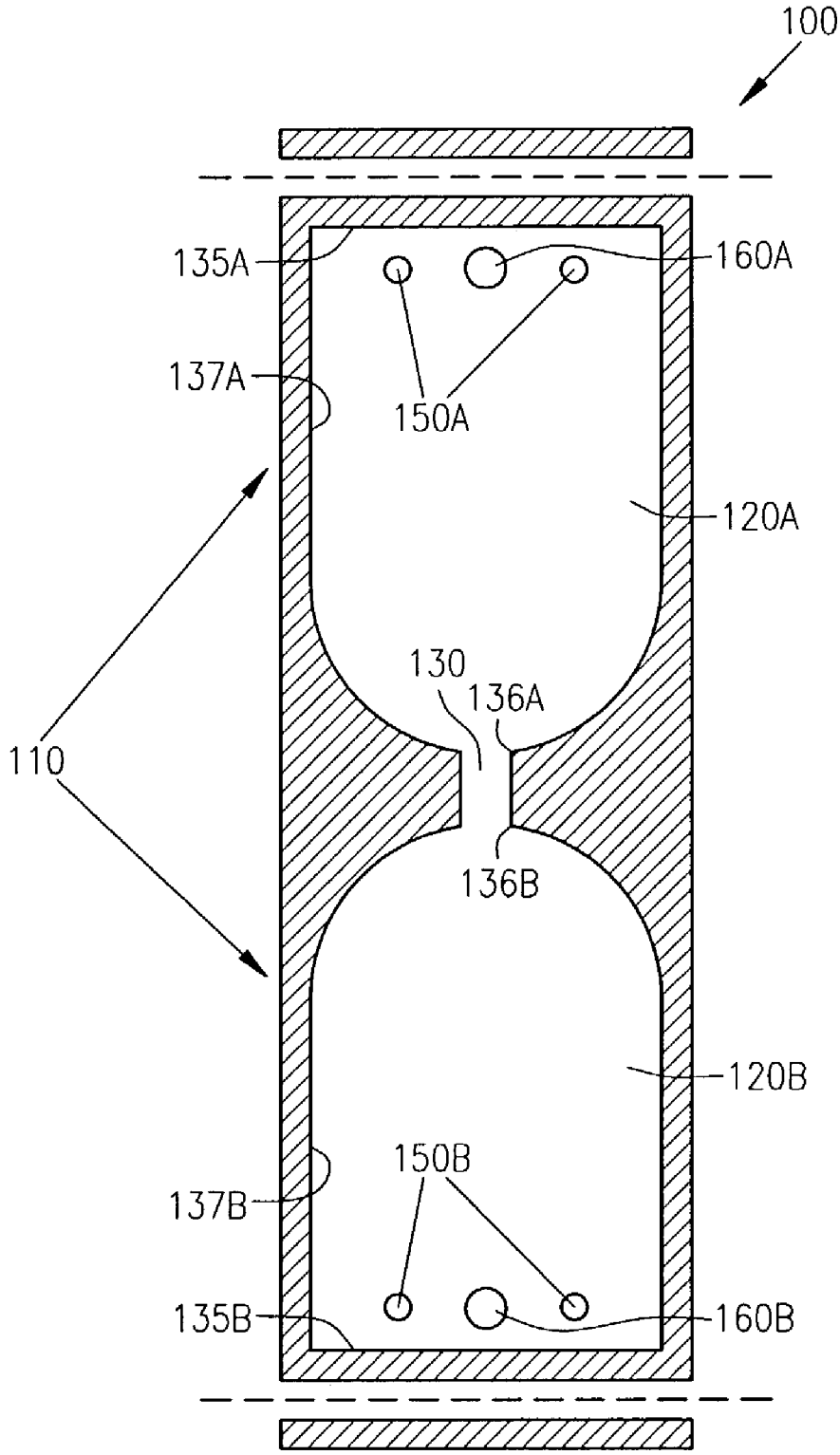
FIG. 1 illustrates a frontal view of a flexible mixing tank, according to an embodiment of the invention.

In one embodiment, a flexible mixing tank is a single-use apparatus used to mix two or more substances. Accordingly, the flexible mixing tank is discarded after a single use, thereby eliminating the washing/sterilizing operations as well as the maintenance associated with convention mixing devices. Moreover, as will be described, in one embodiment, a number of inlet and outlet openings are incorporated into the flexible mixing tank to reduce the amount of human contact with the substances (which may be hazardous, dangerous and/or infectious) that are to be mixed as part of and during the mixing of such substances. In an embodiment, each substance is introduced by its proper inlet opening to avoid the contact of one substance with another substance until a mix operation is to occur.

In an embodiment, an apparatus includes a conduit. The apparatus also includes two or more flexible compartments. Each of the two or more flexible compartments has an interior wall defining a storage area configured to house a substance. Each of the two or more flexible compartments includes a distal end and a proximal end. The proximal ends of the two or more flexible compartments are coupled to the conduit such that the conduit defines a passageway between the two or more flexible compartments. A diameter of the storage area at the proximal end is less than a diameter of the storage area at the distal end.

In one embodiment, an apparatus includes a first flexible compartment having an interior wall defining a first storage area to hold a first substance. The apparatus also includes a second flexible compartment having an interior wall defining a second storage area to hold a second substance. The apparatus includes a third flexible compartment having an interior wall defining a third storage area to hold a third substance. Additionally, the apparatus includes a junction element coupled between the first flexible compartment, the second flexible compartment and the third flexible compartment. A passage of the junction element to the third flexible compartment is to be closed for at least a partial time when the first substance and the second substance are to at least partially mix through the junction element during rotation of the apparatus.

The apparatus includes a clamp coupled to a part of the junction element to a passage of the junction element to the third flexible compartment for at least a partial time when the first substance and the second substance are to at least partially mix through the junction element during rotation of the apparatus.

In an embodiment, a system includes a single-use flexible mixing apparatus that includes a conduit, a first flexible compartment and a second flexible compartment. The first flexible compartment has an interior wall defining a first storage area to hold a first substance. Additionally, the first flexible compartment has a distal end and a proximal end. The proximal end of the first flexible compartment is coupled to the conduit. A width of the first storage area is smallest at the proximal end. The second flexible compartment has an interior wall defining a second storage area to hold a second substance. The second flexible compartment has a distal end and a proximal end. The proximal end of the second flexible compartment is coupled to the conduit. A width of the second storage area is smallest at the proximal end. The system also includes a mixing support to support the single-use flexible mixing apparatus.

In one embodiment, a method includes mixing the two or more substances based on rotation of a single-use flexible mixing device. The single-use flexible mixing device includes a conduit and two or more flexible compartments. Each of the two or more flexible compartments has an interior wall defining a storage area configured to house a substance. Each of the two or more flexible compartments includes a distal end and a proximal end. The proximal ends of the two or more flexible compartments are coupled to the conduit such that the conduit defines a passageway between the two or more flexible compartments. A diameter of the storage area at the proximal end is less than a diameter of the storage area at the distal end.

In an embodiment, a method includes loading a number of different substances into a number of separate compartments of a single-use flexible mixing device through separate inlets for the number of different substances. The method also includes mixing the number of different substances through a single connection that couples the number of separate compartments together based on rotation of the single-use flexible mixing device.

In one embodiment, a method includes closing passages between a first compartment, a second compartment and a third compartment of a single-use flexible mixing apparatus at a connection that connects the first compartment, the second compartment and the third compartment. The method also includes loading a first substance in the first compartment through a first inlet in the first compartment. The method includes loading a second substance in the second compartment through a second inlet in the second compartment. The method includes loading a third substance in the third compartment through a third inlet in the third compartment. Additionally, the method includes opening the opening for the first compartment and the opening for the second compartment. The first substance in the first compartment is mixed with the second substance in the second compartment based on rotation of the single-use flexible mixing apparatus. The opening for the third compartment is opened. The method also includes mixing the third substance in the third compartment with the mixture of the first substance and the second substances based on rotation of the single-use flexible mixing apparatus. Further, the method includes draining a result of the mixing of the third substance in the third compartment with the mixture of the first substance and the second substance from an outlet opening in the first compartment. The method includes discarding the single-use flexible mixing apparatus.

In an embodiment, a kit includes a flexible mixing device. The flexible mixing device includes a conduit and two or more flexible compartments. Each of the two or more flexible compartments has an interior wall defining a storage area configured to house a substance. Each of the two or more flexible compartments comprises a distal end and a proximal end. The proximal ends of the two or more flexible compartments are coupled to the conduit such that the conduit defines a passageway between the two or more flexible compartments. A diameter of the storage area at the proximal end is less than a diameter of the storage area at the distal end. The kit includes packaging material and instructions or indicia located on the packaging material or inside the packaging material.

DETAILED DESCRIPTION

A method, apparatus and system for different embodiments for mixing solids, liquids and/or gases are described. Embodiments of the invention are described to include a mixing tank that is flexible. The mixing tank can be manufactured from any suitable material. In an embodiment, the mixing tank is made of any suitable material having a property where upon removal of an extending force, it is capable of substantially recovering its original size and shape and/or exhibits a significant retractive force. As such, the mixing tank may be made of any suitable type of stretchable, collapsible and/or elastic material.

As used herein, the term "collapsible" refers to a material that may fold down into a more compact shape.

As used herein, the term "pliable" refers to a material that is supple or adjustable enough to bend freely without breaking.

As used herein, the term "elastic," or "elastomeric" refers to that property of a material where upon removal of an extending force, it is capable of substantially recovering its original size and shape and/or exhibits a significant retractive force.

As used herein, the term "stretch," or "stretchable" refers to a material that is either elastic or extensible. That is, the material is capable of being extended, deformed, or the like, without breaking, and may or may not significantly retract after removal of an extending force. In an embodiment, the stretchable material can optionally be biaxial stretchable.

As used herein, the term "biaxial stretch" or "biaxial stretchable" refers to a material having stretchability in two directions perpendicular to one another, e.g. stretchability in a machine direction and in a cross machine direction, or in a longitudinal direction (front to back) and a lateral direction (side to side).

The mixing tank can be manufactured from any suitable material. Suitable materials include, e.g., films, polymers, thermoplastic polymers, homopolymers, copolymers, block copolymers, graft copolymers, random copolymers, alternating copolymers, terpolymers, metallocene polymers, nonwoven fabric, spunbonded fibers, meltblown fibers, polycellulose fibers, polyester fibers, polyurethane fibers, polyolefin fibers, polyamide fibers, cotton fibers, copolyester fibers, open cell foam, polyurethane, polyvinyl chloride, polyethylene, metals, alloys, fiberglass, glass, plastic (e.g., polyethylene (PE), polypropylene (PP), polyvinyl chloride (PVC), polyethylene terephtalate (PET) and Teflon), rubber, and combinations or mixtures thereof.

As used herein, the term "film" refers to a thermoplastic film made using a film extrusion and/or foaming process, such as a cast film or blown film extrusion process. For the purposes of the present invention, the term includes nonporous films as well as microporous films. Films may be vapor permeable or vapor impermeable, and function as liquid barriers under normal use conditions.

As used herein, the term "thermoplastic" refers to uncrosslinked polymers of a thermally sensitive material which flows under the application of heat or pressure.

As used herein, the term "polymers" include, but are not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to isotactic, syndiotactic and atactic symmetries.

As used herein, the term "metallocene polymers" refers to those polymer materials that are produced by the polymerization of at least ethylene using metallocenes or constrained geometry catalysts, a class of organometallic complexes, as catalysts.

As used herein, the term "nonwoven" and "nonwoven web" refer to fibrous materials and webs of fibrous material which are formed without the aid of a textile weaving or knitting process.

As used herein, "spunbonded fibers" refers to small diameter fibers which are formed by extruding molten thermoplastic material as filaments from a plurality of fine capillaries of a spinnerette having a circular or other configuration, with the diameter of the extruded filaments then being rapidly reduced.

As used herein, "meltblown fiber" refers to fibers formed by extruding a molten thermoplastic material through a plurality of fine, usually circular, die capillaries as molten threads or filaments into converging high velocity heated gas (e.g., air) streams which attenuate the filaments of molten thermoplastic material to reduce their diameter, which may be to microfiber diameter (the average microfiber diameter is not greater than about 100 microns, for example, having an average diameter of from about 0.5 microns to about 50 microns, more particularly, microfibers may have an average diameter of from about 4 microns to about 40 microns).

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Embodiments of the invention include features, methods or processes embodied within machine-executable instructions provided by a machine-readable medium. A machine-readable medium includes any mechanism which provides (i.e., stores and/or transmits) information in a form accessible by a machine (e.g., a computer, a network device, a personal digital assistant, manufacturing tool, any device with a set of one or more processors, etc.). In an exemplary embodiment, a machine-readable medium includes volatile and/or non-volatile media (e.g., read only memory (ROM); random access memory (RAM); magnetic disk storage media; optical storage media; flash memory devices; etc.), as well as electrical, optical, acoustical or other form of propagated signals (e.g., carrier waves, infrared signals, digital signals, etc.).

Such instructions are utilized to cause a general or special purpose processor, programmed with the instructions, to perform methods or processes of the embodiments of the invention. Alternatively, the features or operations of embodiments of the invention are performed by specific hardware components which contain hard-wired logic for performing the operations, or by any combination of programmed data processing components and specific hardware components. Embodiments of the invention include software, data processing hardware, data processing system-implemented methods, and various processing operations, further described herein.

A number of figures show block diagrams of systems and apparatus for mixing solids, liquids and/or gases, in accordance with embodiments of the invention. A number of figures show flow diagrams illustrating operations for mixing solids, liquids and/or gases. The operations of the flow diagrams will be described with references to the systems/apparatus shown in the block diagrams. However, it should be understood that the operations of the flow diagrams could be performed by embodiments of systems and apparatus other than those discussed with reference to the block diagrams, and embodiments discussed with reference to the systems/apparatus could perform operations different than those discussed with reference to the flow diagrams.

FIG. 1 illustrates a frontal view of a flexible mixing tank, according to an embodiment of the invention. In particular, FIG. 1 illustrates a frontal view of a flexible mixing tank (apparatus/device) 100 that includes a film 110 that defines a first compartment 120A and a second compartment 120B. The first compartment 120A and the second compartment 120B are separated by a connection (conduit) 130. As shown, the connection 130 is a two-part connector for the first compartment 120A and the second compartment 120B.

The first compartment 120A has an interior wall 137A that defines a storage area configured to house a first substance. The first compartment 120A also includes a distal end 135A and a proximal end 136A, which are distal and proximal relative to the connection 130. As shown, beginning at the distal end 135A, the diameter of the first compartment 120A decreases as the proximal end 136A is approached. In other words, in an embodiment, a diameter of the storage area at the proximal end 136A of the first compartment 120A is less in comparison to a diameter of the storage area at the distal end 135A of the first compartment 120A.

The second compartment 120B has an interior wall 137B that defines a storage area configured to house a second substance. The second compartment 120B also includes a distal end 135B and a proximal end 136B, which are distal and proximal relative to the connection 130. As shown, beginning at the distal end 135B, the diameter of the second compartment 120B decreases as the proximal end 136B is approached. In other words, in an embodiment, a diameter of the storage area at the proximal end 136B of the second compartment 120B is less in comparison to a diameter of the storage area at the distal end 135B of the second compartment 120B.

The flexible mixing tank 100 (including the compartments 120 and the connection 130) is part of a single film. During use/operation, the first compartment 120A and the second compartment 120B communicate with each other through the connection 130. The connection 130 defines a passageway between the first compartment 120A and the second compartment 120B. In particular, a substance in the first compartment 120A and a substance in the second compartment 120B communicate with each other (e.g., are mixed together) through the connection 130.

As shown, the connection 130 in reference to the first compartment 120A and the second compartment 120B provide an hour glass-shaped flexible mixing tank that allows the connection 130 to throttle the admixing of a first substance in the first compartment 120A with a second substance in the second compartment 120B. Moreover, this hour glass-shaped flexible mixing tank allows for the isolation of the two substances prior to or during the admixing operation by closing the connection 130 through a number of devices (e.g., a clamp).

The first compartment 120A includes a number of inlet openings 150A and an outlet opening 160A. The second compartment 120B includes a number of inlet openings 150B and an outlet opening 160B. A more detailed description of the different components of the flexible mixing tank 100 will be described below in conjunction with the description of the different components of a flexible mixing tank 200 shown in FIG. 2.

Figure 2:
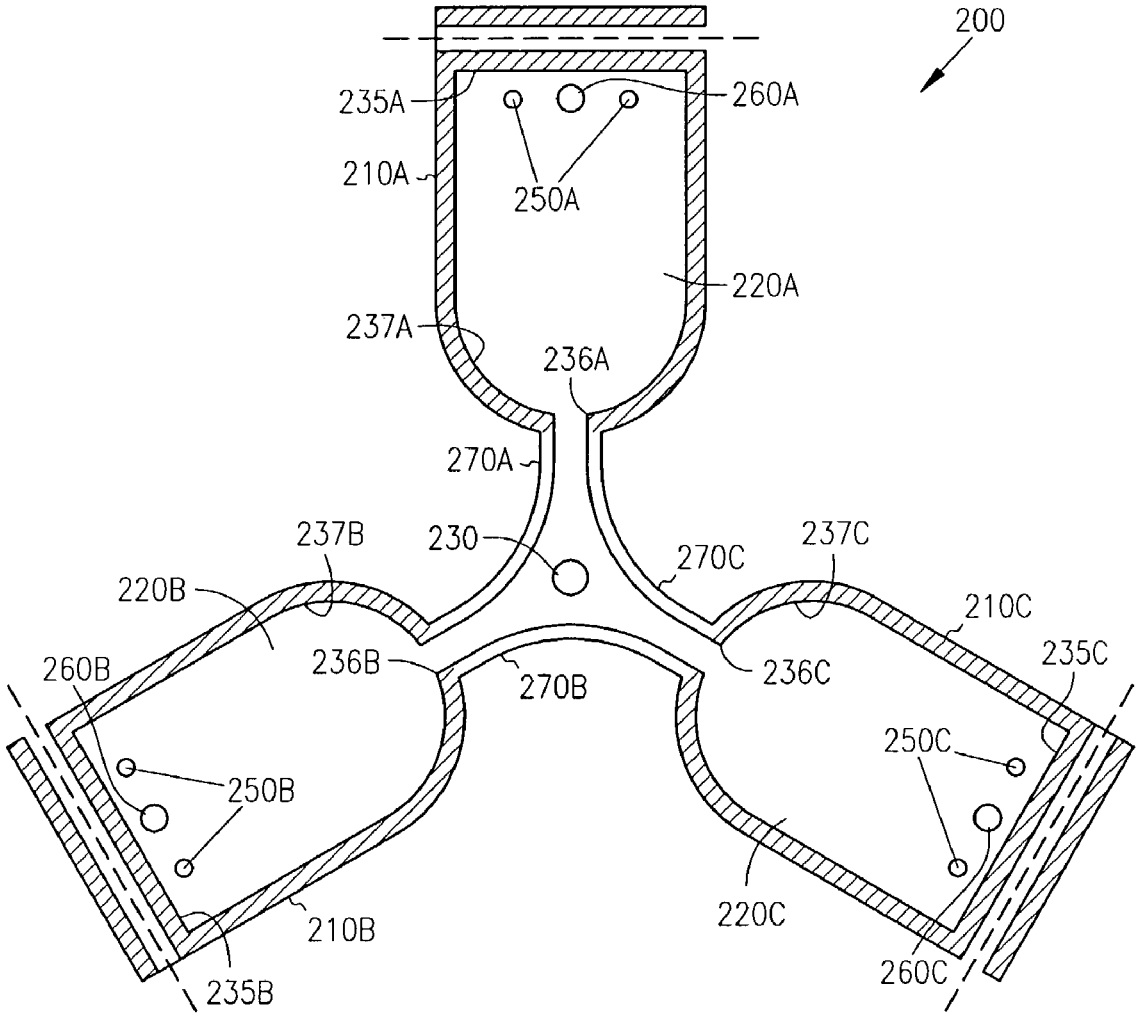
FIG. 2 illustrates a frontal view of a flexible mixing tank, according to another embodiment of the invention.

FIG. 2 illustrates a frontal view of a flexible mixing tank, according to another embodiment of the invention. In particular, FIG. 2 illustrates a frontal view of a flexible mixing tank (apparatus/device) 200 that includes a film 210A, a film 210B and a film 210C. The film 210A defines a first compartment 220A. The film 210B defines a second compartment 220B. The film 210C defines a third compartment 220C. The first compartment 220A, the second compartment 220B and the third compartment 220C are separated by a connection (conduit) 230. In an embodiment, the different compartments 220A–220C are separately formed from different films 210, wherein the connection 230 is a junction element having a number of handles 270A–270C for connecting the compartments 220A–220C to the junction element.

The first compartment 220A has an interior wall 237A that defines a storage area configured to house a first substance. The first compartment 220A also includes a distal end 235A and a proximal end 236A, which are distal and proximal relative to the connection 230. As shown, beginning at the distal end 235A, the diameter of the first compartment 220A decreases as the proximal end 236A is approached. In other words, in an embodiment, a diameter of the storage area at the proximal end 236A of the first compartment 220A is less in comparison to a diameter of the storage area at the distal end 235A of the first compartment 220A.

The second compartment 220B has an interior wall 237B that defines a storage area configured to house a second substance. The second compartment 220B also includes a distal end 235B and a proximal end 236B, which are distal and proximal relative to the connection 230. As shown, beginning at the distal end 235B, the diameter of the second compartment 220B decreases as the proximal end 236B is approached. In other words, in an embodiment, a diameter of the storage area at the proximal end 236B of the second compartment 220B is less in comparison to a diameter of the storage area at the distal end 235B of the second compartment 220B.

The third compartment 220C has an interior wall 237C that defines a storage area configured to house a second substance. The third compartment 220C also includes a distal end 235C and a proximal end 236C, which are distal and proximal relative to the connection 230. As shown, beginning at the distal end 235C, the diameter of the third compartment 220C decreases as the proximal end 236C is approached. In other words, in an embodiment, a diameter of the storage area at the proximal end 236C of the third compartment 220C is less in comparison to a diameter of the storage area at the distal end 235C of the third compartment 220C.

During use/operation, the first compartment 220A, the second compartment 220B and the third compartment 220C communicate with each other (e.g., are mixed together) through the connection 230. The connection 230 defines a passageway between the first compartment 220A, the second compartment 220B and the third compartment 220C. In particular, a first substance in the first compartment 220A, a second substance in the second compartment 220B and a third substance in the third compartment 220C communicate with each other through the connection 230. The connection 230 is a junction element that includes a handle 270A coupled to the first compartment 220A, a handle 270B coupled to the second compartment 220B and a handle 270C coupled to the third compartment 220C. Accordingly for the connection 230, the number of handles equals the number of compartments 220 in the flexible mixing tank 230. The connection 230 (acting as a junction element) may be coupled to the different compartments 220 based on a number of different types of connections. For example, the connection 230 may be coupled to the different compartments 220 by joining, welding or with an intermediate element such as a clamping collar, heat shrinkable sleeve, shrink down plastic tubing or a nesting/screwing connection. While the connection 130 in the flexible mixing tank 100 of FIG. 1 is not illustrated as a junction element having a number of handles 270, embodiments of the invention are not so limited, as the connection 130 (in FIG. 1) could be replaced with a junction element like the connection 230, wherein the junction element includes two handles.

As shown, the connection 230 in reference to the first compartment 220A, the second compartment 220B and the third compartment 220C provide a wheel of compartments 220 whose axis is the connection 230. Because of the small size of the openings from the compartments 220 into the connection 230, the connection 230 is able to throttle the admixing of the different substances in the different compartments 220 together. Further, this small size of the openings allows for the isolation of substances prior to or during the admixing operation by closing one or more of the passages into the connection 230 (using a number of different devices, such as a clamp). For example, the passage from the first compartment 220A into the connection 230 may be closed, while the flexible mixing tank 200 rotates to allow for admixing of the substance in the second compartment 220B with the substance in the third compartment 220C. Subsequently, the passage of the first compartment 220A may be opened to allow for the admixing of the substance in the first compartment 220A with the result of the admix operation of the substances in the second compartment 220B and the third compartment 220C. Accordingly, (as will be described in more detail below) this opening and closing of the openings into the connection 230 allows for the mixing of different substances in a given order at different points in time, thereby enabling a precise mixing protocol to be followed with regard to the substances in the compartments 220.

The first compartment 220A includes a number of inlet openings 250A and an outlet opening 260A. The second compartment 220B includes a number of inlet openings 250B and an outlet opening 260B. The third compartment 220C includes a number of inlet openings 250C and an outlet opening 260C.

A more detailed description of the different components of the flexible mixing tank 100 of FIG. 1 and the flexible mixing tank 200 of FIG. 2 will now be described. The films 110/210A–210C may be any type of flexible material for providing a flexible mixing apparatus (e.g., different types of plastics). For example, the films 110/210A–210C may be heat-welded plastic films. In an embodiment, the films

110/210A–210C are plastic films with a thickness in range of 10 to 400 millimeters (depending on the type of application). While the films 110/210A–210C may be made from a number of different plastics, in an embodiment, the films 110/210A–210C are made from a plastic that includes the following group: polyethylene (PE), polypropylene (PP), polyvinyl chloride (PVC), polyethylene terephtalate (PET) and Teflon. In an embodiment, the films 110/210A–210C are a stretchable material, having a deformation, e.g., of less than approximately five percent when subjected to a tensile force of 100 gmf per inch (per 2.54 cm) of width. The films 110/210A–210C define the compartments 120/220 such that the substances therein are isolated from the outside medium/environment. The films 110/210A–210C also have a mechanical resistance such that the flexible mixing tank 100/200 may be used under pressure from the outside medium/environment.

In an embodiment, the compartments 120/220 are approximately clear to allow for the viewing of the substances and the mixture thereof, such that one skilled in the art may determine when the mix operation is complete based on viewing of the substances. In one embodiment, the surface of the compartments 120/220 includes volumetric indicia for measuring the volume of the substances therein.

In an embodiment, the flexible mixing tank 100/200 is a single-use apparatus. In particular, the flexible mixing tank 100/200 is used a single time to mix, at least partially, substances in the different compartments 120/220. The result of the mixing of the substances is removed from the flexible mixing tank 100/200 (as described in more detail below). Thereafter, the flexible mixing tank 100/200 is discarded. Accordingly, there is no need to wash/sterilize the flexible mixing tank 100/200 in preparation for subsequent uses. Moreover, because the flexible mixing tank 100/200 is a single-use apparatus, the flexible mixing tank 100/200 does not have the ongoing maintenance costs associated with conventional mixing devices.

The number of inlet openings 150A–150B, 250A–250C allow for the introduction of substances ("raw materials" or "reactants") to be mixed within the flexible mixing tank 100/200. Accordingly, each substance is introduced by its proper inlet opening to avoid the contact of one substance with another substance until a mix operation is to occur. As such, an embodiment includes a kit, wherein the kit includes the flexible mixing tank 100/200 of the present invention. The kit also includes substances located in the different compartments 120/220. In an embodiment, the substances avoid contact with each other during the manufacturing, shipping, and storage of such flexible mixing tank 100/200.

The outlet openings 160A–160B, 260A–260C allow for the draining of the compartments 120A–120B, 220A–220C. While the flexible mixing tank 100/200 is illustrated with inlet openings that are separate from the outlet openings, embodiments of the invention are not so limited. For example, in an embodiment, a single opening could be in each of the given compartments for inputting substances into the compartments, wherein at least one of such openings is also used to output the result of the admix operation performed based on rotation of the flexible mixing tank 100/200.

In one embodiment, the number of inlet openings 150A–150B, 250A–250C and the outlet openings 160A–160B, 260A–260C include a base plate welded onto the internal or external face of the compartment 120/220 such that one end of the opening emerges inside the compartment 120/220 and the other end emerges outside the compartment 120/220. Furthermore, the number of inlet openings 150A–150B, 250A–250C and the outlet openings 160A–160B, 260A–260C may be closed using a number of devices, such as a tight plug. In one embodiment, the diameters of the number of inlet openings 150A–150B, 250A–250C and the outlet openings 160A–160B, 260A–260C is dependent on the flow rate that the substance is to be introduced into the compartment 120/220 and/or the admix operation that is to occur by rotation of the flexible mixing tank 100/200. For a gas substance, the gas inlet and outlet rate (or pressure) may be such that there is a sufficient homogenization of the substances in the flexible mixing tank 100/200.

In an embodiment, at least one of the number of inlet openings 150A–150B, 250A–250C and the outlet openings 160A–160B, 260A–260C can be used to introduce different types of probes into the flexible mixing tank 100/200. For example, pH, pO2, temperature or pressure probes can be introduced into the flexible mixing tank 100/200 through the number of inlet openings 150A–150B, 250A–250C and the outlet openings 160A–160B, 260A–260C to check the status of the substances and/or the result of the mixing of such substances within the flexible mixing tank 100/200.

With regard to the substances to be stored in the different compartments 120/220, such substances that are admixed (mixed), at least partially together, during rotation of the flexible mixing tank 100/200 may be in different phases (different types of solids, liquids and/or gases). For example, the solid substances may be different types of powders. The liquid substances may be in different organic phases and/or aqueous phases. The gases may include oxygen, air, nitrogen, argon, carbon dioxide, etc. In one embodiment, the substances are substantially homogenized. Moreover, the different substances may or may not be soluble in reference to each other.

Any of a number of combinations of different substances in different phases can be admixed in accordance with embodiments of the invention. For example, a first substance in a solid phase may be mixed with a second substance in a solid phase. A first substance in a solid phase may be mixed with a second substance in a liquid phase. In one such embodiment, a powder is suspended in a liquid substance when the powder may be partially or totally insoluble in the liquid substance. In an embodiment wherein the powder is totally soluble, the operation of the flexible mixing tank 100/200 is such that the result is a homogenized solution of the powder and the liquid.

Further, a first substance in a liquid phase may be mixed with a second substance in a liquid phase. In one embodiment, the first liquid substance may be partially soluble, totally soluble or totally insoluble with reference to the second liquid substance. If at least one liquid substance is at least partially insoluble in at least another liquid substance, an emulsion is obtained after the mixing/stirring of the flexible mixing tank 100/200. In an embodiment, if the liquid substances are soluble in reference to each other, the operation of the flexible mixing tank 100/200 is such that the result is a homogenized solution of the two different liquid substances.

A first substance in a liquid phase may be mixed with a second substance in a gas phase. The gas may be inert or may react with at least one component of the liquid substance. For example, a gas (that is relatively reactive under the desired conditions) may be oxygen or carbon dioxide when culturing cells or microorganisms or to provide for an oxidation reaction.

The width/diameter of a compartment 120/220 and the width/diameter of a connection 130/230 are dependent on the size of the flexible mixing tank 100/200. The width/diameter of the connection 130/230 is large enough to allow substances to efficiently enter and exit the compartments 120/220, while small enough to allow for efficient mixing of the substances in the different compartments 120/220. Specifically, the width/diameter of the connection 130/230 will be small enough to ensure that substances will contact one another when entering/exiting the compartments 120/220.

In one embodiment, the ratio of the width/diameter of the connection 130/230 to the width/diameter of a compartment 120/220 is greater than 0.01. For example, in one embodiment, this ratio is in a range of about 0.01 to 1.0. In one embodiment, the ratio of the width/diameter of the connection 130/230 to the width/diameter of a compartment 120/220 is less than 0.9. In an embodiment, the width/diameter of the connection 130/230 is considerably smaller than the width/diameter of a compartment 120/220. For example, the ratio of the connection 130/230 to a compartment 120/220 is about 0.01 to about 0.7, about 0.05 to about 0.5, about 0.05 to about 0.25 or about 0.1 to about 0.2.

In one embodiment, the flexible mixing tank 100/200 also includes one to a number of valves to allow for a release mechanism in the event that pressure builds up within the flexible mixing tank 100/200 because of the mixing/rotation operation. The diameter of the connection 130/230 may be dependent on the types and characteristics of the substances to be mixed that are within the different compartments 120/220. Examples of the type of characteristics that the diameter of the connection 130/230 is dependent include viscosity, granulometry, density, thixotropy and rheoscopy. As described above, in one embodiment, a compartment 120/220 may be isolated from the other compartments 120/220 by closure of the passages through the connection 130/230, using for example, clips, clamps, flaps, etc. In one embodiment, a mesh or screen is located at the openings of the compartments 120/220 into the connection 130/230. Accordingly, when a solid substance is mixed with a liquid substance, the mesh or screen diminished the likelihood and/or severity of clogging at the openings into the connection 130/230.

Figure 3A:
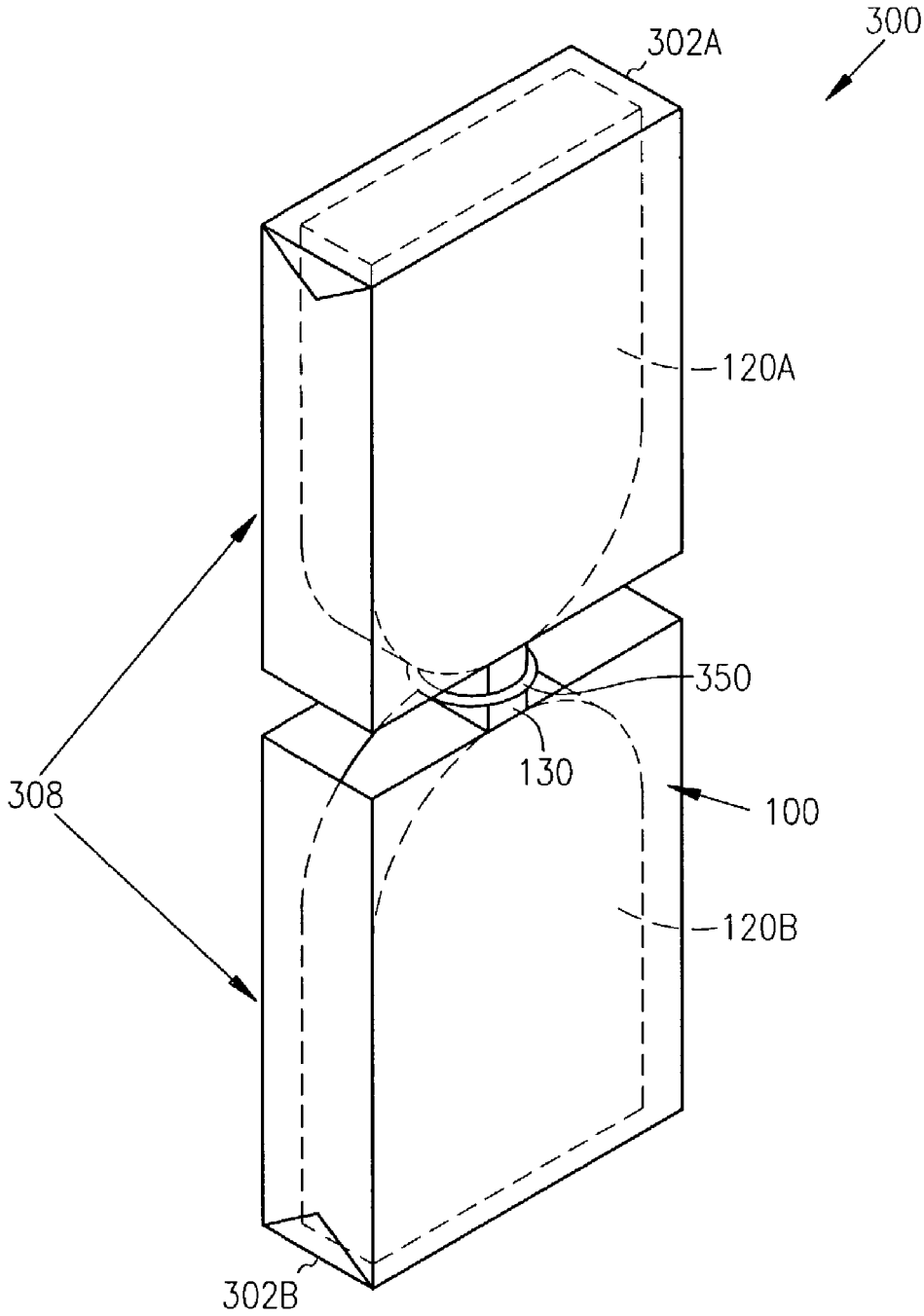
FIGS. 3A–3C illustrate systems for mixing substances, according to embodiments of the invention.
Figure 3B:
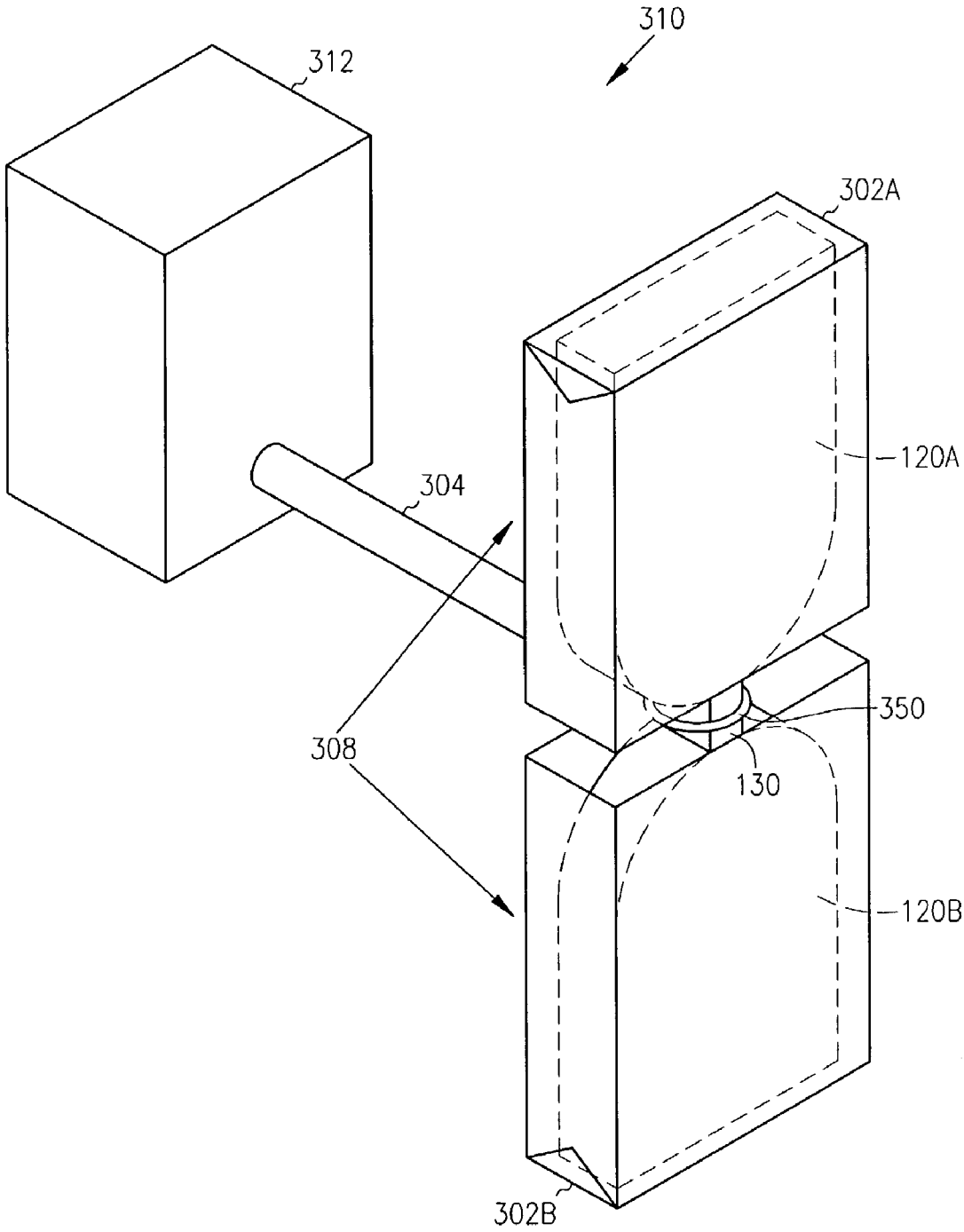
Figure 3C:
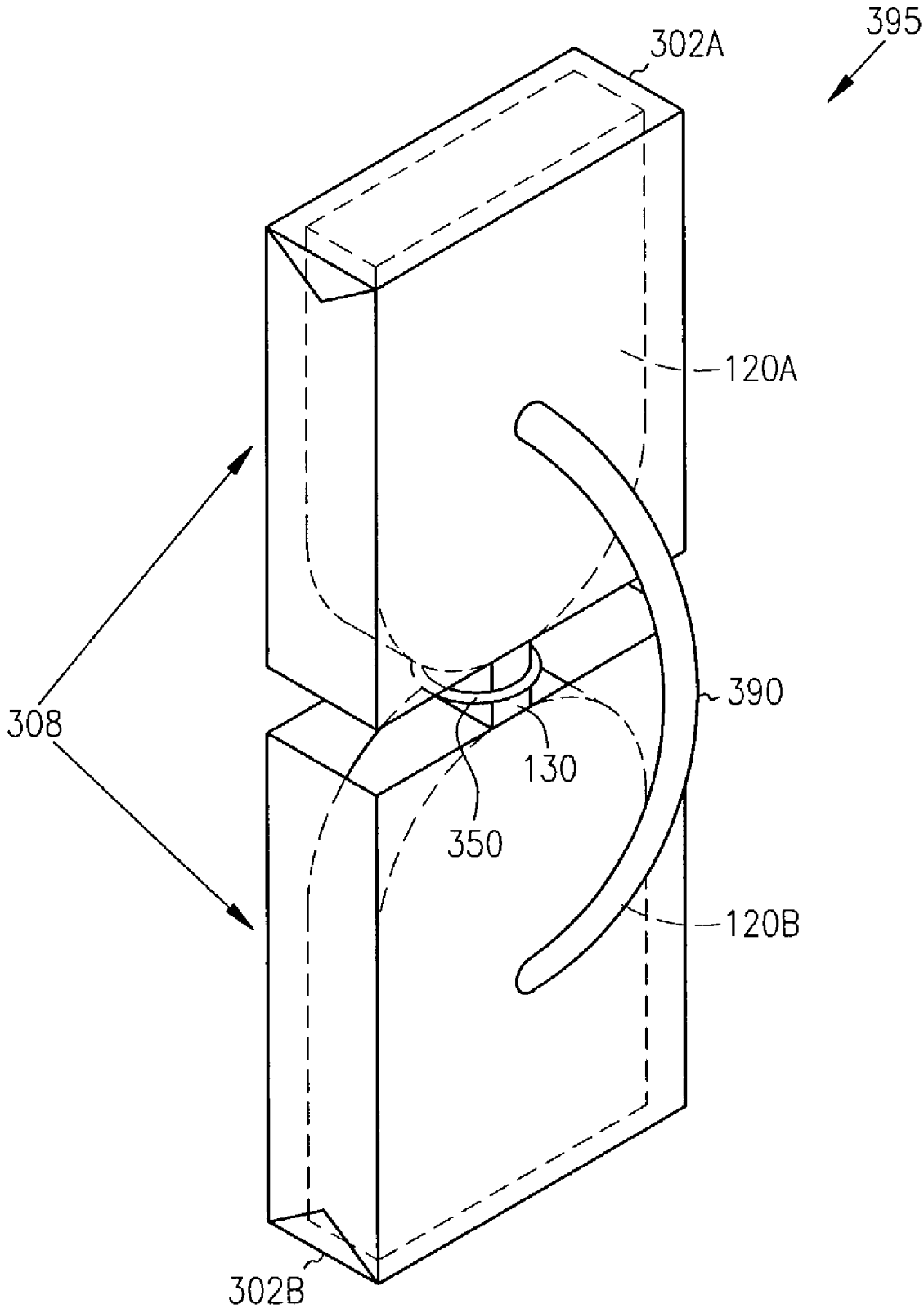

FIGS. 3A–3C illustrate systems for mixing substances, according to embodiments of the invention. As shown, a system 300 includes the flexible mixing tank 100 and a mixing support 308. In the embodiment of the system 300, the mixing support 308 includes support sleeves 302A–302B. As shown, the support sleeve 302A and the support sleeve 302B cover the compartment 120A and the compartment 120B, respectively, and are on opposite sides of the connection 130. In an embodiment, the support sleeves 302A–302B are coupled to the compartments 120A–120B, respectively through one of a number of connection apparatus (e.g., a clip, a hook, etc.). Accordingly, the support sleeves 302A–302B support the compartments 120A–120B to maintain a sufficient tension for the compartments 120A–120B during loading of the substances into the compartments 120A–120B as well as during mixing of the substances in the compartments 120A–120B based on rotation of the flexible mixing tank 100. As shown, in one embodiment, the system 300 includes a clamp 350 that precludes the mixing of the substances until the rotation/mix operation is to occur.

In an embodiment, because of the flexibility of the flexible mixing tank 100, a low pressure gas is inserted into the flexible mixing tank 100 to support the compartments 120A–120B when placing the flexible mixing tank 100 into the mixing support 308 as well as during rotation of the flexible mixing tank 100. In one embodiment, the low pressure gas is a range of 20–100 millibars. This gas may be inserted into the flexible mixing tank 100 through the number of inlet openings 150A–150B and the outlet openings 160A–160B (shown in FIG. 1).

A mixing support for the flexible mixing apparatus 100 is not limited to the mixing support 308 illustrated in FIG. 3A. In an embodiment, a mixing support includes a different type of support for assistance during rotation of the flexible mixing apparatus 100. For example, the mixing support may include a clip, a clamp, etc., that is located at different points on the flexible mixing apparatus 100. Moreover, embodiments of the invention may include a combination of such mixing supports. For example, the mixing support may include the support sleeves 302A–302B and a clip to assist in the rotation of the flexible mixing tank 100.

FIG. 3B illustrates a system 310 that includes the flexible mixing tank 100 and the mixing support 308 (as described above for the system 300). The system 310 also includes a control apparatus 312 that is coupled to the mixing support 308 through a rotation handle 304. The rotation handle 304 may be coupled to the support sleeves 302A–302B and/or to the flexible mixing tank 100. The control apparatus 312 may include a processor to execute machine-readable instructions for controlling the rotation of the flexible mixing tank 100, including the number of turns, the rate of rotation, how far to turn for a given rotation (1/N of a 360° turn for N number of compartments 120), etc. (as described in more detail below in conjunction with the description of the flow diagram 500 of FIG. 5).

FIG. 3C illustrates a system 395 that includes the flexible mixing tank 100 and the mixing support 308 (as described above for the system 300). The system 395 also includes a mixing handle 390 that is coupled to the mixing support 308. The mixing handle 390 may be coupled to the support sleeves 302A–302B and/or to the flexible mixing tank 100. Accordingly, an apparatus and/or individual may mix the substances in the flexible mixing tank 100 using the mixing handle 390 (as described in more detail below in conjunction with the description of the flow diagram 500 of FIG. 5).

Figure 4A:
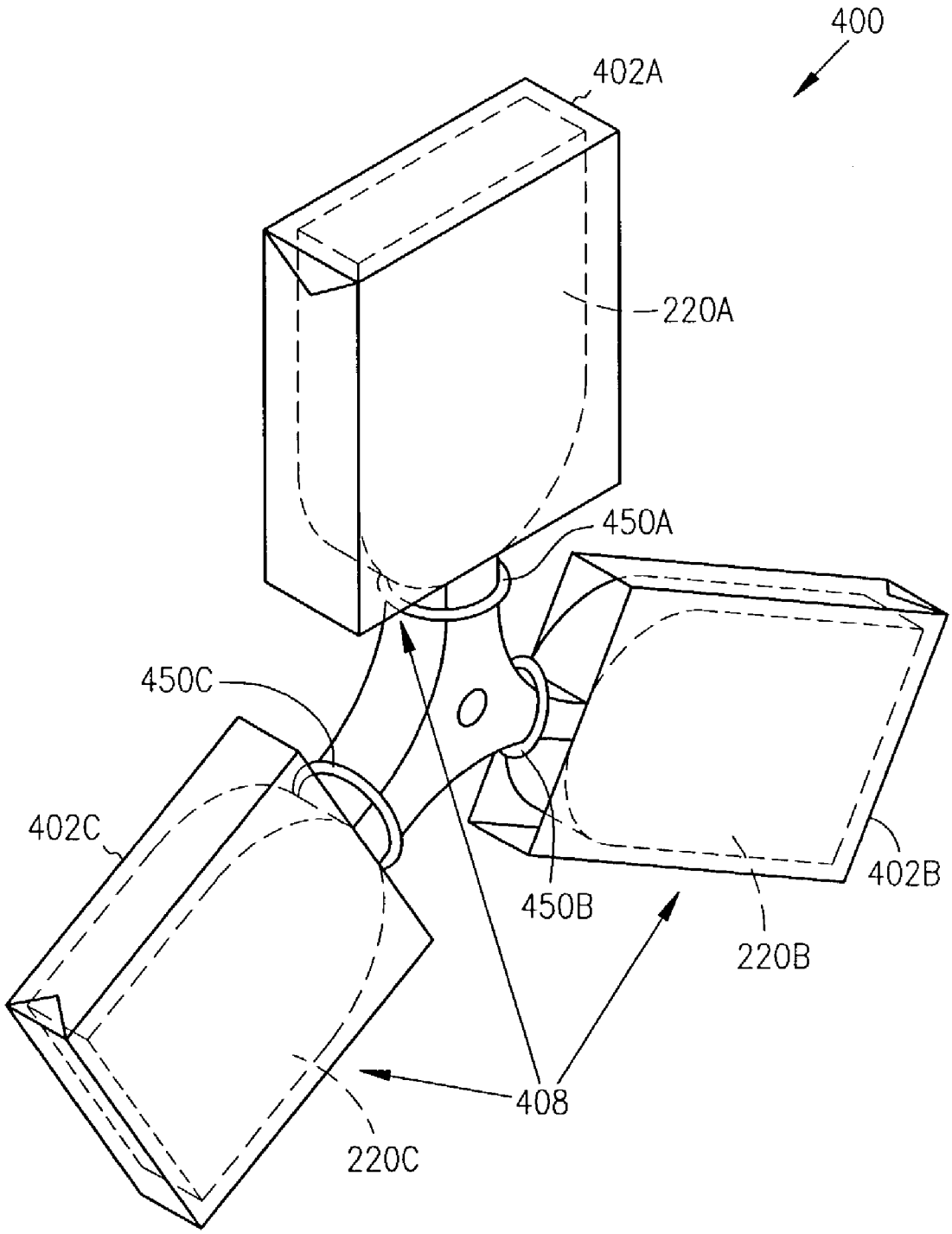
FIGS. 4A–4C illustrate systems for mixing substances, according to other embodiments of the invention.
Figure 4B:
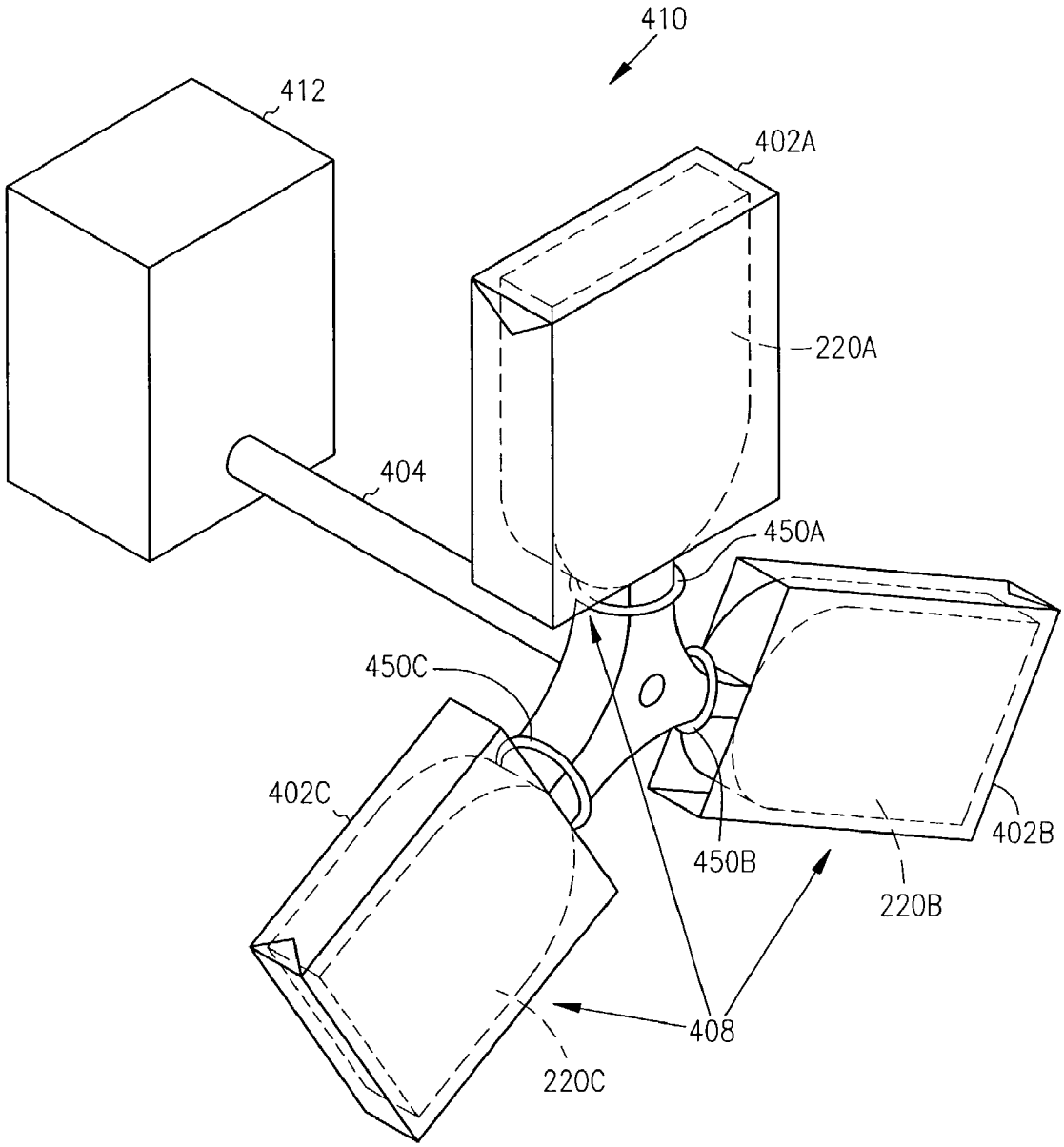
Figure 4C:
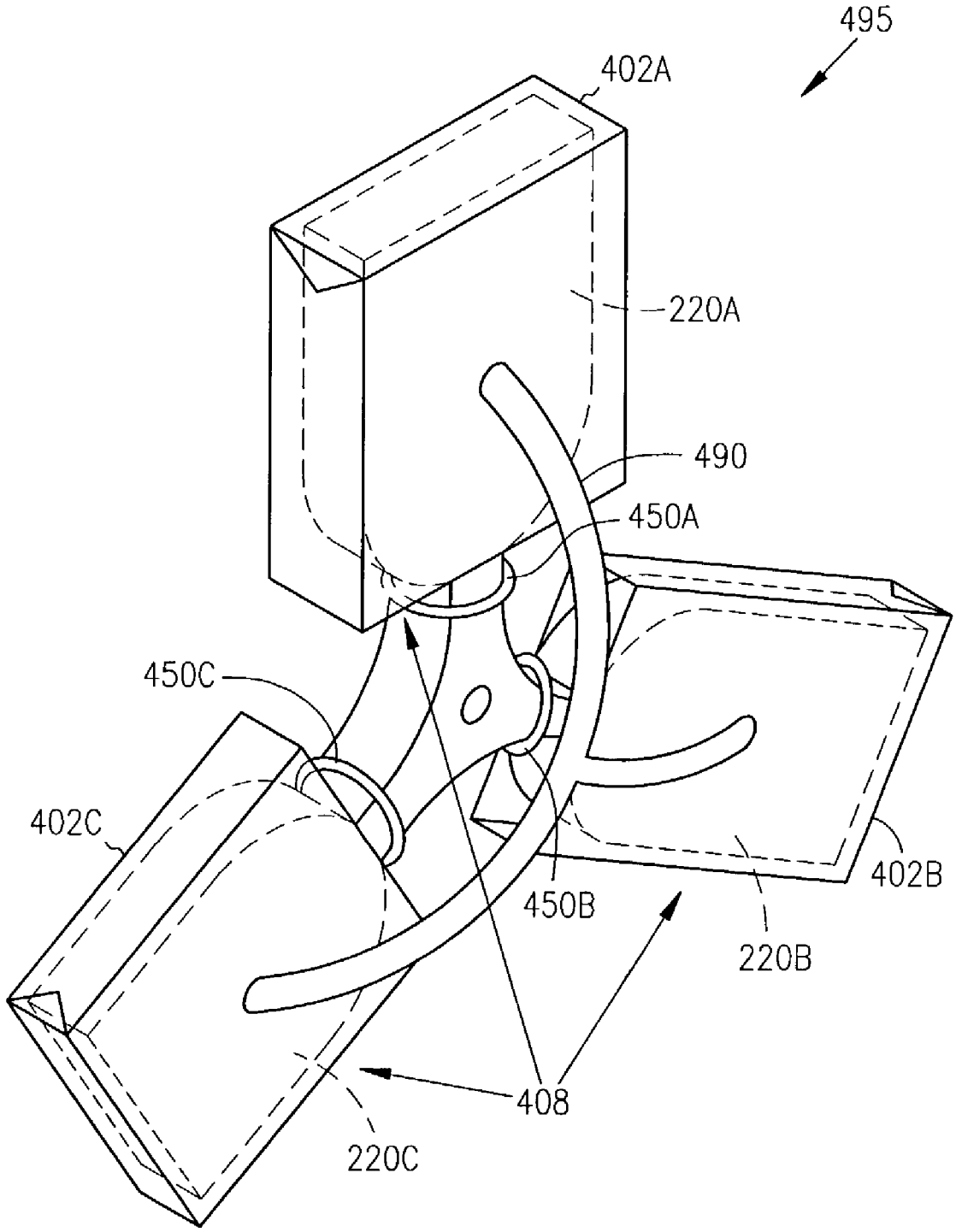

FIGS. 4A–4C illustrate systems for mixing substances, according to other embodiments of the invention. As shown, a system 400 includes the flexible mixing tank 200 and a mixing support 408. In the embodiment of the system 400, the mixing support 408 includes support sleeves 402A–402C. As shown, the support sleeve 402A, the support sleeve 402B and the support sleeve 402C cover the compartment 220A, the compartment 220B and the compartment 220C, respectively, and are on different sides of the connection 230. In an embodiment, the support sleeves 402A–402C are coupled to the compartments 220A–220C, respectively through one of a number of connection apparatus (e.g., a clip, a hook, etc.). Accordingly, the support sleeves 402A–402C support the compartments 220A–220C to maintain a sufficient tension for the compartments 220A–220C during loading of the substances into the compartments 220A–220C and during mixing of the substances in the compartments 220A–220C based on rotation of the flexible mixing tank 200. As shown, in one embodiment, the system 400 includes a number of clamps 450A–450C that preclude the mixing of the substances until the rotation/mix operation is to occur. The clamp 450A is coupled to preclude the substance in the compartment 220A from entering the connection 230. The clamp 450B is coupled to preclude the substance in the compartment 220B from entering the connection 230. The clamp 450C is coupled to preclude the substance in the compartment 220C from entering the connection 230.

In an embodiment, because of the flexibility of the flexible mixing tank 200, a low pressure gas is inserted into the flexible mixing tank 200 to support the compartments 220A–120C when placing the flexible mixing tank 200 into the mixing support 408 as well as during rotation of the flexible mixing tank 200. In one embodiment, the low pressure gas is in a range of 20–100 millibars. This gas may be inserted into the flexible mixing tank 200 through the number of inlet openings 250A–250C and the outlet openings 260A–260C.

A mixing support for the flexible mixing apparatus 200 is not limited to the mixing support 408 illustrated in FIG. 4A. In one embodiment, a mixing support includes a different type of support for assistance during rotation of the flexible mixing apparatus 200. For example, the mixing support may include a clip, a clamp, etc., that is located at different points on the flexible mixing apparatus 200. Moreover, embodiments of the invention may include a combination of such mixing supports. For example, the mixing support may include the support sleeves 402A–402C and a clip to assist in the rotation of the flexible mixing tank 200.

FIG. 4B illustrates a system 410 that includes the flexible mixing tank 200 and the mixing support 408 (as described above for the system 400). The system 410 also includes a control apparatus 412 that is coupled to the mixing support 408 through a rotation handle 404. The rotation handle 404 may be coupled to the support sleeves 402A–402C and/or to the flexible mixing tank 200. The control apparatus 412 may include a processor to execute machine-readable instructions for controlling the rotation of the flexible mixing tank 200, including the number of turns, the rate of rotation, how far to turn for a given rotation (1/N of a 360° turn for N number of compartments 220), etc. (as described in more detail below in conjunction with the description of the flow diagram 500 of FIG. 5).

FIG. 4C illustrates a system 495 that includes the flexible mixing tank 200 and the mixing support 408 (as described above for the system 400). The system 495 also includes a mixing handle 490 that is coupled to the mixing support 408. The mixing handle 490 may be coupled to the support sleeves 402A–402C and/or to the flexible mixing tank 200. Accordingly, an apparatus and/or individual may mix the substances in the flexible mixing tank 200 using the mixing handle 490 (as described in more detail below in conjunction with the description of the flow diagram 500 of FIG. 5).

Figure 5:
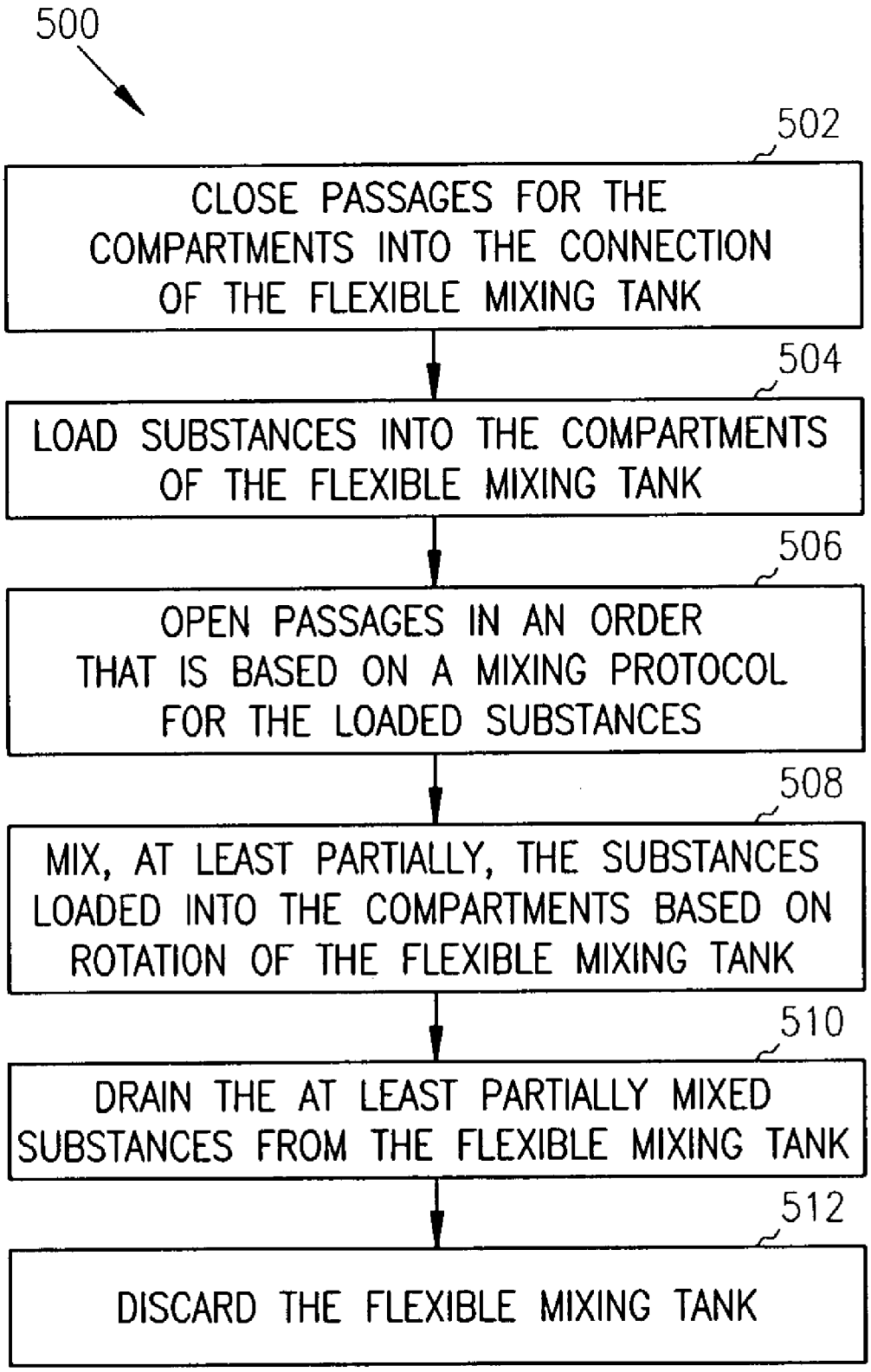
FIG. 5 illustrates a flow diagram for mixing substances, according to an embodiment of the invention.

FIG. 5 illustrates a flow diagram for mixing substances, according to an embodiment of the invention. The flow diagram 500 illustrates the operations of the flexible mixing tank 100/200, according to an embodiment of the invention.

In block 502, passages for the compartments 120/220 into the connection 130/230 of the flexible mixing tank 100/200 are closed. A number of clamps may be used to close the passages for the compartments 120/220. As described above, at least one of the passages for the compartments 120/220 into the connection 130/230 are closed in order to isolate a substance in one of the compartments 120/220 from the substances in the other compartments 120/220. This closure of the passages allows the mixing of two or more substances during rotation of the flexible mixing tank 100/200, while isolating one or more other substances. Subsequently, these closed passages may be opened in an order that is in accord with a mixing protocol for the substances to be loaded into the compartments 120/220. For example, a more homogenous solution may be derived for three substances if a first substance and a second substance are mixed, followed by the mixing of the third substance into the mixture of the first substance and the second substance. Control continues at block 504.

In block 504, substances are loaded into the compartments 120/220 of the flexible mixing tank 100/200. The substances are loaded into the compartments 120/220 through the number of inlet openings 150A–150B, 250A–250C. As described above, the number of inlet openings 150A–150B, 250A–250C allow for the introduction of substances ("raw materials" or "reactants") to be mixed within the flexible mixing tank 100/200. Accordingly, each substance is introduced by its proper inlet opening to avoid the contact of one substance with another substance until a mix operation is to occur. Control continues at block 506.

The open passage operation is described in block 506, and the mix operation is described in block 508. While described such that the operations of the block 508 are subsequent to the operations of the block 506, embodiments are not so limited. For example, as described above, different passages may be opened at different times during the mixing of the substances in order to follow a mix protocol for a given set of substances. Accordingly, the opening of a passage may follow a first mix operation, which is followed by a second mix operation.

In block 506, the passages (that are closed) are opened in an order that is based on a mixing protocol for the loaded substances. In one embodiment, all of the passages are opened. In an embodiment, less than all of the passages are opened, thereby leaving one or more substances in isolation during a first mix operation based on a mix protocol for the given set of substances (as described above). Control continues at block 508.

In block 508, the substances loaded into the compartments 120/220 are mixed, at least partially, based on rotation of the flexible mixing tank 100/200. The mixing of the substances may be performed by an individual and/or the control apparatus 312/412 (shown in FIG. 3 and FIG. 4). The mixing of the substances may be carried out by a number of rotations of the flexible mixing tank 100/200, wherein one rotation includes rotating at least 1/N of a 360° turn (wherein N is the number of compartments). In one embodiment, the rotation is in a given plane that includes the compartments 120/220. The rotation is around the center of the flexible mixing tank 100/200. In an embodiment, the center of rotation is at the gravity center of the flexible mixing tank 100/200. This gravity center may be the gravity center of the connection 130/230. In an embodiment, the gravity center corresponds to the symmetrical center of the flexible mixing tank 100/200.

In one embodiment, the flexible mixing tank 100/200 is placed in an approximately vertical position, thereby enabling the mixing of the substances based on gravity during the rotation of the flexible mixing tank 100/200. Therefore, at least a part of the component contained in one of the compartments 120/220 is transferred by gravity to at least one other compartment upon rotation of the flexible mixing tank 100/200. In an embodiment to generate a homogenous solution, the rotation of the flexible mixing tank 100/200 continues until the substances are approximately homogenized. In an embodiment that includes a liquid and a powder that is at least partially insoluble, the rotation of the flexible mixing tank 100/200 continues until the powder is suspended in the liquid.

Moreover, as described above, a number of open passage operations and mix operations may occur in order to follow a given mix protocol. Accordingly, a number of mix operations may occur until the different substances are mixed, at least partially, into the final resulting substance. Control continues at block 510.

In block 510, the at least partially mixed substances are drained from the flexible mixing tank 100/200. In an embodiment, the flexible mixing tank 100/200 is positioned such that when a plug is removed from one of one of the number of inlet openings 150A–150B, 250A–250C and the outlet openings 160A–160B, 260A–260C gravity is used to drain the at least partially mixed substances from the flexible mixing tank 100/200. Further, the drain operation may be facilitated. For example, when the substance is a viscous solution having a slow flow, the drain operation may be facilitated through a number of operations. In an embodiment, the drain operation is facilitated by an increase in pressure initiated by introducing a gas into one of the number of inlet openings 150A–150B, 250A–250C and the outlet openings 160A–160B, 260A–260C. In one embodiment, the drain operation may be facilitated by a flattening device (such as a rolling pin).

In an embodiment, an aspiration cane is used (through one of the number of inlet openings 150A–150B, 250A–250C and the outlet openings 160A–160B, 260A–260C) to drain the at least partially mixed substances from the flexible mixing tank 100/200. In one such embodiment, the compartment from which the draining occurs is at a higher height than that of the other compartments. In one embodiment, a pump coupled to a conduit is coupled to one of the number of inlet openings 150A–150B, 250A–250C and the outlet openings 160A–160B to facilitate the drain operation by pumping gas (such as air) into the flexible mixing tank 100/200. Control continues at block 512.

In block 512, the flexible mixing tank 100/200 is discarded. In particular, the flexible mixing tank 100/200 is discarded after a single use. Accordingly, the washing/sterilizing operations as well as the maintenance associated with convention mixing devices are not needed. Moreover, as described, embodiments of the invention reduce the amount of human contact with the substances (which may be hazardous, dangerous and/or infectious) that are to be mixed as part of and during the mixing of such substances.

Thus, a method, apparatus and system for different embodiments for mixing solids, liquids and/or gases have been described. Although the present invention has been described with reference to specific exemplary embodiments, it will be evident that various modifications and changes may be made to these embodiments without departing from the broader spirit and scope of the invention. For example, while embodiments illustrated herein include a two-compartment and three-compartment flexible mixing tank, a greater number of compartments may be incorporated into a flexible mixing tank in accordance with embodiments of the invention. Therefore, the specification and drawings are to be regarded in an illustrative rather than a restrictive sense.

What is claimed is:

1. An apparatus comprising:

a flexible conduit;

two or more flexible compartments disposed substantially symmetrically about the flexible conduit, wherein each of the two or more flexible compartments has an interior wall defining a storage area configured to house a substance, wherein each of the two or more flexible compartments comprises a distal end and a proximal end, the proximal ends of the two or more flexible compartments coupled to the flexible conduit such that the flexible conduit defines a passageway between the two or more flexible compartments, wherein a diameter of the storage area at the proximal end is less than a diameter of the storage area at the distal end, wherein the two or more flexible compartments are configured to be rotated approximately centered around the flexible conduit to mix substances housed in the two or more flexible compartments; and a tension-based mixing support attachable to the two or more flexible compartments for supporting the apparatus during rotation approximately around the flexible conduit.

2. The apparatus of claim 1, wherein the flexible conduit and the two or more flexible compartments are a part of a single film.

3. The apparatus of claim 1, wherein the apparatus is configured to be rotated at least one rotation, the at least one rotation to include at least 1/N of a turn, wherein N is a number of flexible compartments in the apparatus.

4. The apparatus of claim 1, wherein the apparatus is to be discarded after a single use.

5. The apparatus of claim 1, wherein a first of the two or more flexible compartments includes an inlet opening to load a first substance in the first flexible compartment.

6. The apparatus of claim 5, wherein the first substance comprises a solid.

7. The apparatus of claim 5, wherein the first substance comprises a liquid.

8. The apparatus of claim 5, wherein the first substance comprises a gas.

9. The apparatus of claim 1, wherein the flexible conduit is a two-part connector.

10. The apparatus of claim 1, wherein the flexible conduit is a junction element.

11. An apparatus comprising:

a first flexible compartment having an interior wall defining a first storage area to hold a first substance;

a second flexible compartment having an interior wall defining a second storage area to hold a second substance;

a third flexible compartment having an interior wall defining a third storage area to hold a third substance; and a junction element coupled between the first flexible compartment, the second flexible compartment and the third flexible compartment such that the first, second, and third flexible compartments are disposed substantially symmetrically about the junction element, wherein a passage of the junction element to the third flexible compartment is to be closed for at least a partial time when the first substance and the second substance are to at least partially mix through the junction element during rotation of the apparatus, wherein each flexible compartment comprises a distal end and a proximal end, the proximal end of each flexible compartment coupled to the junction element, wherein a diameter of each storage area at the proximal end is less than a diameter of each storage area at the distal end.

12. The apparatus of claim 11, wherein the first flexible compartment includes an inlet opening to load the first substance in the first flexible compartment.

13. The apparatus of claim 11, and further comprising:

a mixing support to support the apparatus.

14. The apparatus of claim 13, wherein the mixing support is to position the single-use flexible mixing apparatus vertically during rotation of the apparatus approximately centered around the conduit.

15. The apparatus of claim 13, wherein the mixing support comprises a first sleeve to cover the first flexible compartment, a second sleeve to cover the second flexible compartment, and a third sleeve to cover the third flexible compartment.

16. A system comprising:

a single-use flexible mixing apparatus comprising a conduit, and a first flexible compartment and a second flexible compartment disposed substantially symmetrically about the conduit, wherein the first flexible compartment has an interior wall defining a first storage area to hold a first substance, the first flexible compartment having a distal end and a proximal end, the proximal end of the first flexible compartment coupled to the conduit, wherein a width of the first storage area is smallest at the proximal end, wherein the second flexible compartment has an interior wall defining a second storage area to hold a second substance, the second flexible compartment having a distal end and a proximal end, the proximal end of the second flexible compartment coupled to the conduit across the conduit from the first flexible compartment, wherein a width of the second storage area is smallest at the proximal end; and a tension-based mixing support to support the single-use flexible mixing apparatus for rotation of the single-use flexible mixing apparatus approximately centered around the conduit to mix the first and second substances.

17. The system of claim 16, wherein the tension-based mixing support is to position the single-use flexible mixing apparatus vertically during rotation of the single-use flexible mixing apparatus approximately centered around the conduit.

18. The system of claim 16, wherein the tension-based mixing support comprises a first sleeve to cover the first compartment and a second sleeve to cover the second compartment.

19. The system of claim 16 further comprising a control apparatus coupled to the tension-based mixing support to control the rotation of the single-use flexible mixing apparatus through execution of machine-readable instructions.

20. The system of claim 19, wherein the machine-readable instructions, when executed, are to cause the tension-based mixing support to rotate at least one rotation, the at least one rotation to include at least 1/N of a turn, wherein N is a number of flexible compartments in the single-use flexible mixing apparatus.

* * * * *